US005995636A

United States Patent [19]

Tøpholm

[11] Patent Number: 5,995,636

[45] **Date of Patent: *Nov. 30, 1999**

[54] HEARING AID

[75] Inventor: Jan Tøpholm, Holte, Denmark

[73] Assignee: Topholm & Westermann ApS, Vaerloese, Denmark

[ * ] Notice: This patent issued on a continued prosecution application filed under 37 CFR 1.53(d), and is subject to the twenty year patent term provisions of 35 U.S.C. 154(a)(2).

[21] Appl. No.: 08/793,489

[22] PCT Filed: Aug. 16, 1995

[86] PCT No.: PCT/EP95/03231

§ 371 Date: Feb. 26, 1997

§ 102(e) Date: Feb. 26, 1997

[87] PCT Pub. No.: WO96/10321

PCT Pub. Date: Apr. 4, 1996

[30] Foreign Application Priority Data

Sep. 29, 1904 [DE] Germany ..... 94 15 594 U

[51] Int. Cl.[6] ..... H04R 25/00

[52] U.S. Cl. ..... 381/323; 381/322

[58] Field of Search ..... 381/69.2, 69, 68, 381/68.6, 323, 322, 314, 324; 429/98, 100, 96, 123; 181/129, 130; 439/500, 504

[56] References Cited

U.S. PATENT DOCUMENTS

| | | | |
|---|---|---|---|
| 4,425,481 | 1/1984 | Mansgold et al. | 381/98 |
| 4,634,815 | 1/1987 | Marquis | 381/328 |
| 4,941,180 | 7/1990 | Buettner | 381/69.2 |
| 5,201,007 | 4/1993 | Ward et al. . | |
| 5,201,008 | 4/1993 | Arndt et al. . | |
| 5,588,064 | 12/1996 | McSwiggen et al. | 381/69.2 |
| 5,687,242 | 11/1997 | Iburg | 381/69.2 |

FOREIGN PATENT DOCUMENTS

| | | |
|---|---|---|
| 3505390C2 | 8/1985 | Germany . |
| 389611 | 1/1990 | Germany . |

*Primary Examiner*—Sinh Tran

*Attorney, Agent, or Firm*—Sughrue, Mion, Zinn, Macpeak & Seas, PLLC

[57] ABSTRACT

Hearing aid with a microphone, a transmission section (2) for signal processing with a housing (3) containing an output transducer, a battery compartment containing a battery (4), a cover (5) articulated at the housing or a battery lid **(5*a*) articulated at the housing so that it can be pivoted, said cover or lid serving to close off the battery compartment, an electronic control logic (6), as well as a contact arrangement (7) which can be actuated by pressing on the cover (5) in closed position or the battery lid (5*a*)** in closed position and by means of which the control logic can be activated.

This contact arrangement can be activated by a spring-loaded movement of the cover (5) or battery lid **(5*a*)** beyond the normal closing position.

12 Claims, 3 Drawing Sheets

HEARING AID

BACKGROUND OF THE INVENTION

The invention relates to a hearing aid, particularly an in-the-ear hearing aid in accordance with the preamble of claim 1.

When designing hearing aids, two problems occur which repeatedly lead to difficulties.

On the one hand, the aim is to make in-the-ear hearing aids as small as possible, above all for cosmetic reasons.

On the other hand, the greatest possible variety of control possibilities and features is desirable. If it is then wished to dispense with a remote control, this then poses an almost unsolvable problem.

In particular, ever smaller hearing aids do not have sufficient space to accommodate control elements for volume, high or low frequency reduction, output sound level or even for selection of different transmission characteristics or a changeover switch from the microphone to the telephone coil.

This is especially critical with in-the-ear hearing aids, because the battery cover often occupies a very large proportion of the surface area accessible to the user when wearing the hearing aid.

However, battery covers with On/Off switch have been known for a long time.

As regards the state of the art, DE 35 05 390 C2 describes an in-the-ear hearing aid with a front plate and an adjoining housing with a pivotable cover, whereby said cover possesses a recess on its inner side with the dimensions of at least part of the battery and also a hole which penetrates through the cover, with a pushbutton passing through said hole and contacting the upper side of the battery. A pressure switch which allows the circuit for the hearing aid to be closed is located under the battery, which can be moved in axial direction against a certain spring tension by the pushbutton. In addition, it is known from this patent that the volume can also be adjusted by pressing the pushbutton for a shorter or longer time.

However, this known design is so complex and complicated that the striven for or realizable reduction in the size of the instrument appears to be placed in doubt.

SUMMARY OF THE INVENTION

The present invention uses a simpler and much more elegant method in order to permit simple activation of a large number of the hearing aid functions by means of the battery cover in addition to normal switching on of the instrument.

In order to realize this, the hearing aid designed in accordance with the invention is characterized in that it is provided with an electronic control logic and with a contact arrangement which can be actuated by pressure on the cover in closed position or the battery lid in closed position, whereby the control logic can be activated by said contact arrangement.

The arrangement is preferably such that the contact arrangement can be actuated by a spring-loaded movement of the battery cover beyond the normal closed position.

Further characteristics of the invention are described in the other claims.

BRIEF DESCRIPTION OF THE DRAWING

The invention will now be described in greater detail on the basis of example embodiments in conjunction with the enclosed drawings.

In the drawings.

DETAILED DESCRIPTION OF THE INVENTION

Figure 1:
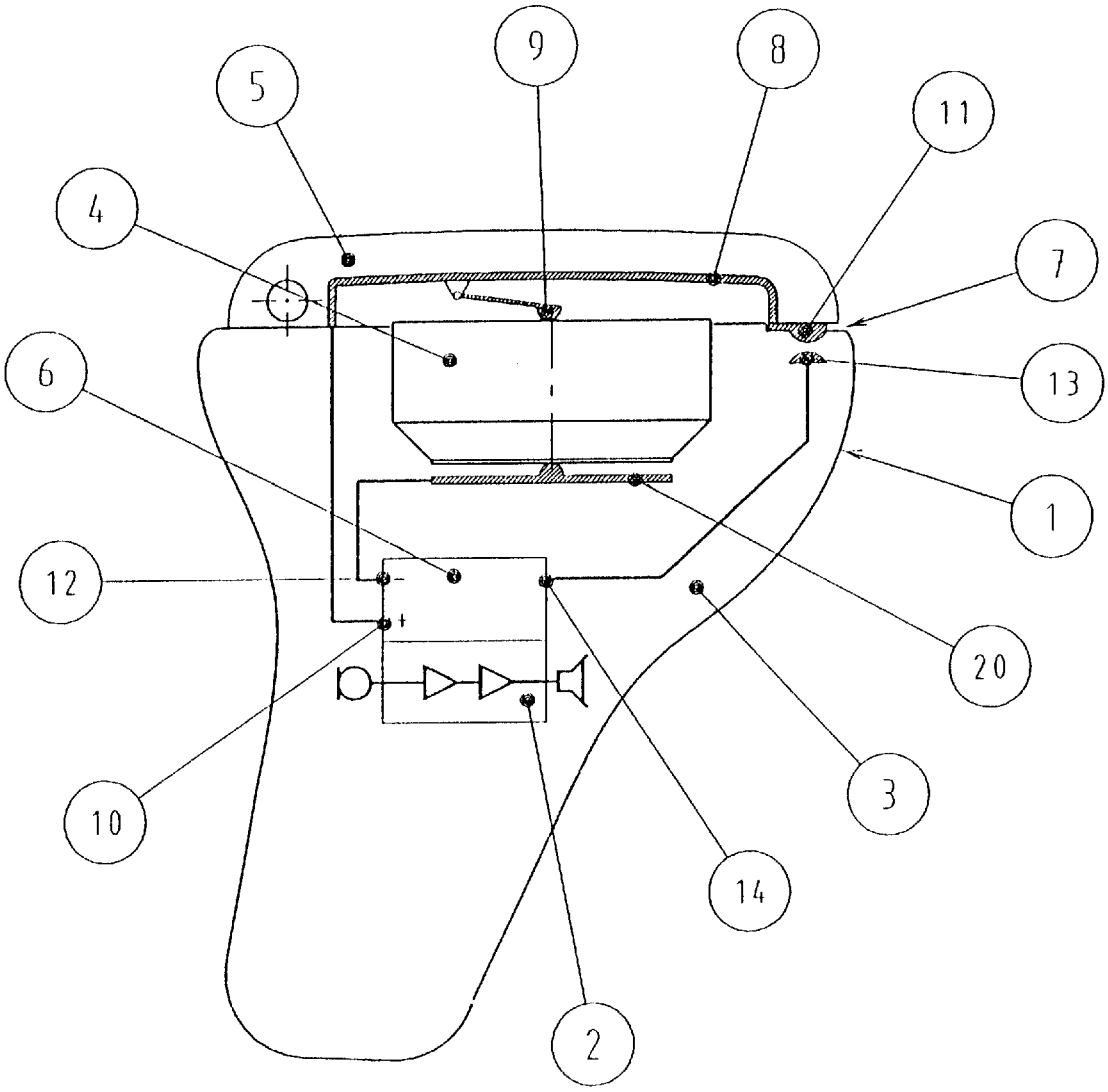
FIG. 1 shows an initial example embodiment of the invention.

FIG. 1 shows in purely schematic form a hearing aid, for example an in-the-ear hearing aid 1, which, in addition to the normal amplifier circuit, a transmission section 2 in the housing 3 located between the microphone and earphone next to the battery 4 contained a battery compartment, which can be closed by a cover 5 articulated at the housing, is provided with an electronic control logic 6, which can be activated by way of a contact arrangement 7 by exerting pressure on the cover in its closed position.

For this purpose, the cover 5 is provided on its inner side with a metallically conductive connection 8, which is conductively connected on one side with one terminal of the battery by way of a preferably resilient contact. This resilient contact 9 contacts, for example, the surface of the battery 4.

This metallically conductive connection 8 is also conductively connected to an input terminal used for power supply to the control logic. In addition, the metallically conductive connection 8 has a make contact 11 on its front side at the edge of the cover.

The other terminal of the battery is conductively connected to the other input terminal 12 used for power supply to the control logic by means of a contact 20.

At the top edge of the housing a contact 13 is provided opposite the make contact 11 which is conductively connected to a control input 14 of the control logic.

The contacts 11 and 13 are separated from each other during normal operation of the hearing aid. The contacts 11 and 13 are closed by a movement beyond the closed position of the cover 5 effected by pressing on said cover, whereby the control logic is activated.

This control logic can contain a number of different programmed transmission characteristics. In addition, one could conceivably activate other criteria such as volume, output sound level, high-frequency reduction or low-frequency reduction by means of this. One conceivable possibility for this would be to actuate the contact 11, 13 several times with different durations, thus providing a large number of activation possibilities.

Figure 2:
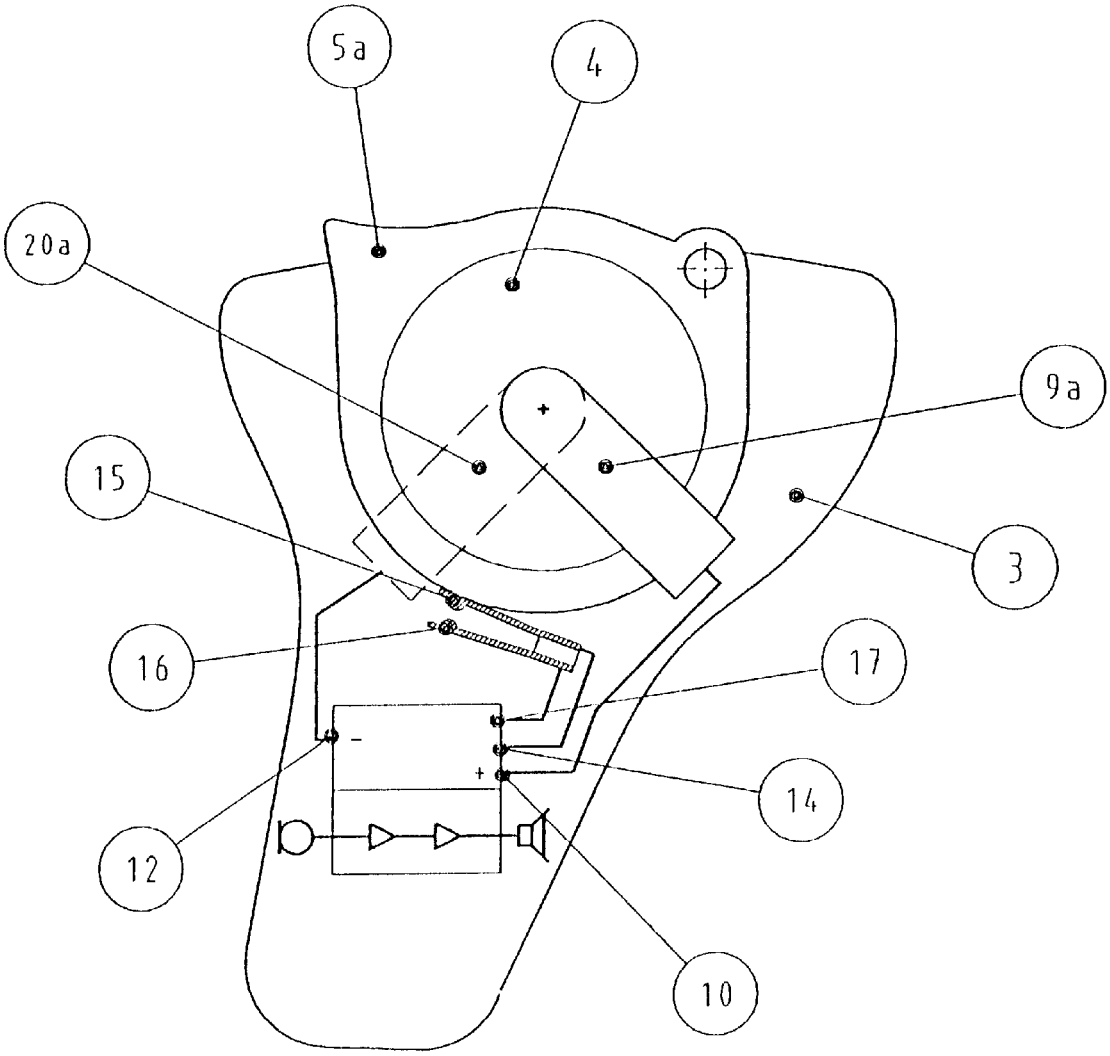
FIG. 2 shows another example embodiment of the invention.

The example embodiment of the invention shown in FIG. 2 shows a hearing aid, preferably an in-the-ear hearing aid with a battery lid 5*a*, whereby said lid can also be moved beyond its normal closed position for activation of the control electronics by means of pressure, preferably against spring action. It is again possible to see the indicated normal hearing aid and the control electronics on top of this in the housing 3. In the normal case, all the electronics of the hearing aid, thus also including the new control electronics 6, would of course be accommodated in a single highly integrated circuit.

In the example embodiment shown here, both terminals of the battery 4 are conductively connected to the input terminals of the control electronics used for power supply, namely input terminals 10 and 12, by means of the connection contacts 9*a* and 20*a*. In addition, a contact arrangement is provided of which one contact 15 is a certain distance away from the second contact 16. The first contact 15 is preferably a resilient contact. The contact 15 is conductively connected to the control input 14 of the control electronics, while the contact 16 is conductively connected to a further control input 17.

The control electronics can then be activated by closing the contacts 15, 16 by means of a movement beyond the normal closed position produced by pressing on the battery lid. It must be noted that the contact 15 contacts the insulating outer side of the battery lid 5*a*, and is therefore not in contact with either of the terminals of the battery. In other words, the control electronics must be designed in such a way that activation is initiated by closing the contacts 15, 16.

The description relating to actuation in FIG. 1 also applies equally to the embodiment in accordance with FIG. 2.

Figure 3:
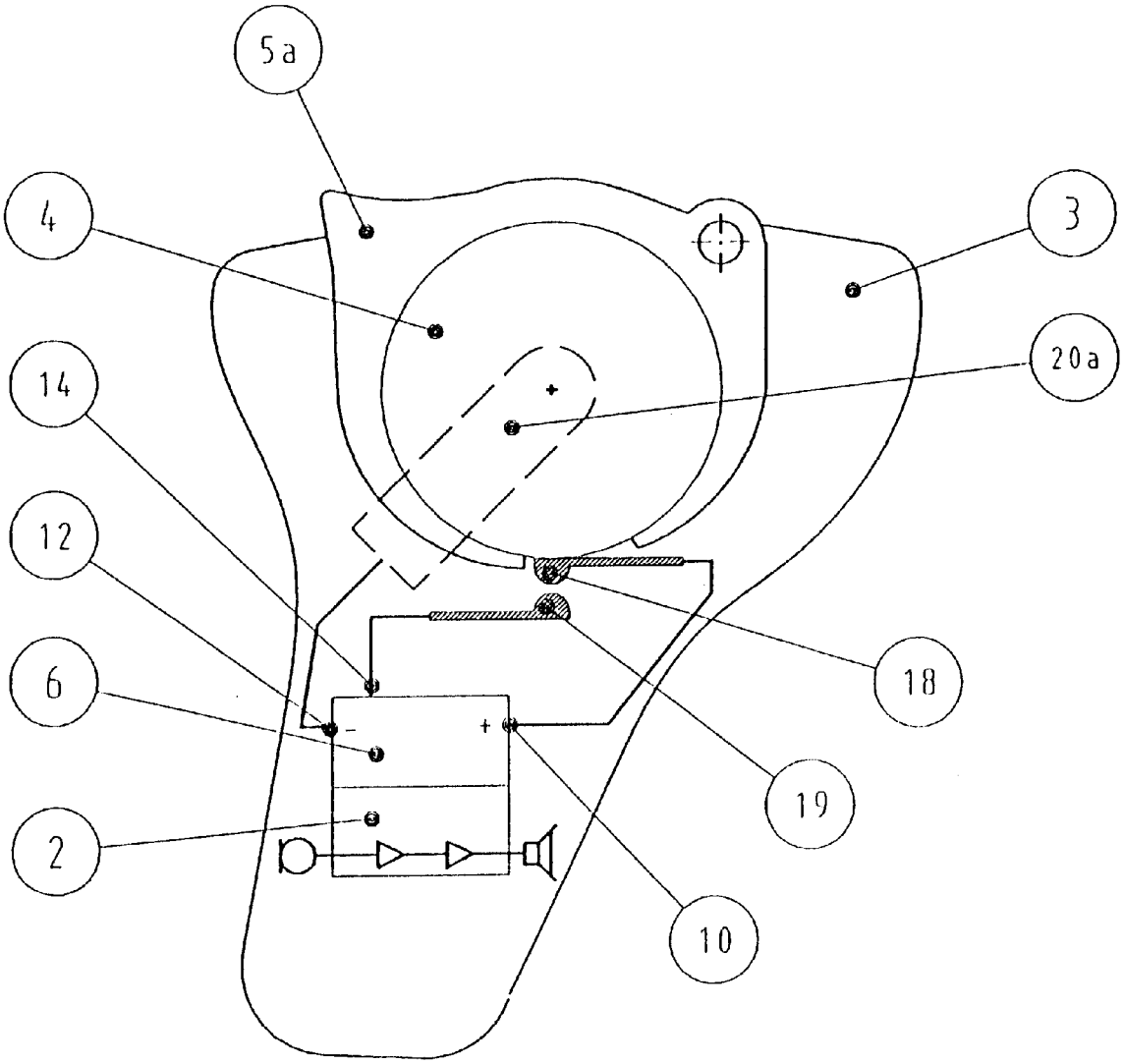
FIG. 3 a further example embodiment of the invention.

FIG. 3 shows a similar embodiment of the invention to FIG. 2, whereby the same parts are provided with the same reference numbers and generally do not need any further explanation.

One terminal of the battery is connected to one input terminal 12 used for power supply to the control logic 6 via the connection contact 20*a*.

A preferably resilient contact 18 of a contact arrangement 18, 19 is provided for power supply to the other input terminal 10 of the control logic 6, whereby the contact 18 is in contact with the metallic outer surface forming the other terminal of the battery. The second contact 19 of the contact arrangement is connected to the control input 14 of the control logic 6.

Actuation, i.e. activation, of the control logic takes place in exactly the same way as in FIG. 2. The contacts 18, 19 can be closed by pressing on the battery lid 5*a* against a certain spring force, thus causing activation of the control logic.

As already described in conjunction with FIG. 1, a number of different functions of the hearing aid can be initiated by multiple operation of the contact arrangement 18, 19 for different durations.

It is thus clear that this relatively simple design of a hearing aid permits activation of different functions of the hearing aid by means of an additionally provided control logic by single or multiple operation of an additional contact arrangement.

What is claimed is:

1. A hearing aid with a microphone, a transmission section for signal processing with a housing containing an output transducer, a battery compartment containing a battery and a cover pivotably coupled to the housing, said cover serving to close off the battery compartment, characterized by an electronic control logic and by a contact arrangement which can be actuated by pressing on the cover in closed position to pivot said cover and thereby activate the control logic to modify the operating characteristics of the hearing aid while the hearing aid is already operating.

2. A hearing aid in accordance with claim 1, characterized in that the contact arrangement can be activated by a spring-loaded movement of the cover beyond the normal closed position.

3. A hearing aid in accordance with claim 1, characterized in that a stop surface for the closed position of the cover is correspondingly offset in order to permit a possible movement of the cover beyond the normal closed position.

4. A hearing aid in accordance with claims 1 to 3, characterized in that the cover possesses a metallically conductive connection on its inner side which contacts one terminal of the battery by way of a preferably resilient contact and which is also connected to a first input terminal for power supply to the control logic and to a make contact located at the edge of the cover, and in that in addition the other terminal of the battery is conductively connected to a second input terminal of the control logic serving the purpose of power supply, and that a contact is provided on the housing opposite the make contact which is connected to a control input of the control logic so that the control logic can be activated by means of the contact contacting the make contact when pressing on the cover.

5. A hearing aid in accordance with claims 1 or 3, characterized in that the cover is spring-loaded for a movement beyond the normal closed position.

6. A hearing aid in accordance with claims 1 to 3 wherein said cover comprises a battery lid (5*a*) carrying a battery and capable of pivoting in and out, characterized in that two terminals of the battery are connected to first and second input terminals of said control logic serving the purpose of power supply to said control logic by way of connection contacts in that in addition said contact arrangement is provided whose contacts are connected to control inputs of the control logic, whereby one of the contacts contacts the insulating outer side of the battery lid, and in that the control logic can be activated by closing the contacts by a possible movement of the battery lid beyond the normal closed position produced by pressing on the battery lid.

7. A hearing aid in accordance with claims 1 to 3, wherein said cover comprises a battery lid (5*a*) carrying a battery and capable of pivoting in and out, characterized in that one terminal of the battery is connected to one input terminal serving the purpose of power supply to the control logic, in that in addition said contact arrangement is provided having first and second contacts, whereby said first contact of said contact arrangement contacts the metallic outer surface of the battery serving as the other terminal, while said second contact is connected to the control input of the control logic, and in that the control logic can be activated by closing said first and second contacts by a possible movement of the battery lid beyond the normal closed position produced by pressing on the battery lid.

8. A hearing aid in accordance with claim 6, characterized in that one contact of the contact arrangement is resilient.

9. A hearing aid in accordance with claim 7, characterized in that one contact of the contact arrangement is resilient.

10. A hearing aid in accordance with claim 1, wherein said cover is pivotable about an axis transverse to an axis of a battery within said battery compartment.

11. A hearing aid in accordance with claim 1, wherein said cover is pivotable about an axis substantially parallel to an axis of a battery within said compartment.

12. A hearing aid with a microphone, a transmission section for signal processing with a housing containing an output transducer, a battery compartment containing a battery and a cover coupled to the housing, said cover serving to close off the battery compartment, characterized by an electronic control logic for controlling multiple operating characteristics of said hearing aid, and by a contact arrangement which can be actuated by pressing on the cover in closed position to activate the control logic, with no movement of said battery being required to activate said control logic, to modify said multiple operating characteristics of the hearing aid while the hearing aid is already operating.

* * * * *